US008726580B1

(12) United States Patent
Hunt

(10) Patent No.: US 8,726,580 B1
(45) Date of Patent: May 20, 2014

(54) STANDING SEAM CEMENTITIOUS ROOF

(76) Inventor: Christopher M. Hunt, Atlanta, GA (US)

( * ) Notice: Subject to any disclaimer, the term of this patent is extended or adjusted under 35 U.S.C. 154(b) by 0 days.

(21) Appl. No.: 11/974,959

(22) Filed: Oct. 15, 2007

(51) Int. Cl.
*E04B 7/02* (2006.01)
*E04B 1/04* (2006.01)
*E04B 7/20* (2006.01)

(52) U.S. Cl.
CPC .... *E04B 1/04* (2013.01); *E04B 7/20* (2013.01)
USPC ..... 52/91.1; 52/309.12

(58) Field of Classification Search
CPC ..... E04B 1/04; E04B 1/12; E04B 7/02; E04B 7/20
USPC ..... 52/91.1, 91.2, 91.3, 11, 302.3, 309.12, 52/270
See application file for complete search history.

(56) References Cited

U.S. PATENT DOCUMENTS 1,061,798 A * 5/1913 Yourtee ..... 52/91.2
1,111,131 A * 9/1914 Broughton ..... 52/270
1,124,404 A * 1/1915 Featherstone ..... 52/372
1,367,289 A * 2/1921 Waller ..... 52/639
1,921,285 A * 8/1933 Davis et al. ..... 52/91.1
1,981,661 A * 11/1934 Pfeifer ..... 52/91.1
2,184,714 A * 12/1939 Freeman ..... 52/250
2,372,200 A * 3/1945 Hayes ..... 52/259
2,499,886 A * 3/1950 Stevens ..... 52/91.1
3,305,982 A * 2/1967 Steele ..... 52/90.1
3,319,387 A * 5/1967 Stewing et al. ..... 52/223.7
3,394,523 A * 7/1968 Sackett, Sr. ..... 52/475.1
3,457,698 A * 7/1969 Teunis ..... 52/223.7
3,600,863 A * 8/1971 Nachtsheim ..... 52/483.1
3,676,198 A * 7/1972 McGroarty ..... 427/180
3,881,286 A * 5/1975 Smith et al. ..... 52/91.3
3,918,222 A * 11/1975 Bahramian ..... 52/223.7
4,187,651 A * 2/1980 Tolsma ..... 52/79.1
4,234,639 A * 11/1980 Graham ..... 428/144
4,240,233 A * 12/1980 Vercelletto ..... 52/127.3
4,300,320 A * 11/1981 Rooney ..... 14/73
4,309,853 A * 1/1982 Lowe ..... 52/91.3
4,430,463 A * 2/1984 Mullenax ..... 524/5
4,455,793 A * 6/1984 Nania ..... 52/91.2
4,590,730 A * 5/1986 Blendick ..... 52/461
4,692,369 A * 9/1987 Nomi ..... 428/198
4,696,451 A * 9/1987 Mansfield ..... 249/16
4,712,349 A * 12/1987 Riley et al. ..... 52/408
4,749,731 A * 6/1988 Kyminas et al. ..... 524/31
4,774,794 A * 10/1988 Grieb ..... 52/309.7
4,859,723 A * 8/1989 Kyminas et al. ..... 524/31
4,909,001 A * 3/1990 Gonzalez Espinosa de Los Monteros ..... 52/92.2
5,316,824 A * 5/1994 George et al. ..... 428/145
5,403,894 A * 4/1995 Tsai et al. ..... 525/285
5,457,917 A * 10/1995 Palmersten ..... 52/91.3
5,552,179 A * 9/1996 Ramun ..... 427/136
5,678,372 A * 10/1997 Thomson et al. ..... 52/432
5,799,453 A * 9/1998 Westerlund ..... 52/259

(Continued)

*Primary Examiner* — William Gilbert
*Assistant Examiner* — James Ference
(74) *Attorney, Agent, or Firm* — Rodgers & Rodgers

(57) ABSTRACT

A system and method for installing a roofing system on a structure, said system comprising: means for installing a plurality of cementitious roof panels adjacent to one another to produce a roof surface having a plurality of substantially vertical oriented seams; means for placing a cementitious seam insert in each seam and attaching each said seam insert to the adjacent cementitious roof panels; and means for coating said cementitious roof panels and said cementitious seam inserts with a coating.

8 Claims, 4 Drawing Sheets

(56) References Cited

U.S. PATENT DOCUMENTS

| | | | | |
|---|---|---|---|---|
| 5,921,046 | A * | 7/1999 | Hammond, Jr. | 52/564 |
| 5,987,827 | A * | 11/1999 | Lord | 52/274 |
| 5,996,304 | A * | 12/1999 | Barker et al. | 52/741.41 |
| 6,076,319 | A * | 6/2000 | Hendershot et al. | 52/271 |
| 6,119,417 | A * | 9/2000 | Valverde et al. | 52/223.7 |
| 6,460,302 | B1 * | 10/2002 | Neuhaus et al. | 52/261 |
| 6,931,809 | B1 * | 8/2005 | Brown et al. | 52/409 |
| 6,942,915 | B1 * | 9/2005 | Kondo et al. | 428/174 |
| 6,955,014 | B2 * | 10/2005 | LeJeune et al. | 52/223.6 |
| 7,051,483 | B2 * | 5/2006 | Bamford | 52/414 |
| 7,104,020 | B1 | 9/2006 | Suttle | |
| 7,114,695 | B2 * | 10/2006 | DeLoach, Sr. | 249/18 |
| 7,204,060 | B2 | 4/2007 | Hunt | |
| 7,353,642 | B1 * | 4/2008 | Henriquez | 52/741.41 |
| 2001/0045070 | A1 | 11/2001 | Hunt | |
| 2002/0078659 | A1 | 6/2002 | Hunt | |
| 2002/0174606 | A1 | 11/2002 | Hunt | |
| 2003/0067096 | A1 * | 4/2003 | Jurik | 264/333 |
| 2003/0079438 | A1 * | 5/2003 | Stephens et al. | 52/782.1 |
| 2004/0103608 | A1 * | 6/2004 | Lionel | 52/408 |
| 2005/0066587 | A1 * | 3/2005 | Brisson | 52/79.1 |
| 2005/0229504 | A1 * | 10/2005 | Bennett et al. | 52/105 |
| 2005/0247012 | A1 * | 11/2005 | Williams | 52/742.14 |
| 2005/0257469 | A1 * | 11/2005 | Bennett et al. | 52/408 |
| 2006/0003144 | A1 | 1/2006 | Kaump | |
| 2007/0056223 | A9 | 3/2007 | Hunt | |
| 2007/0294976 | A1 * | 12/2007 | Fay | 52/515 |
| 2008/0066395 | A1 * | 3/2008 | Aranda et al. | 52/90.1 |
| 2008/0104917 | A1 * | 5/2008 | Whelan et al. | 52/408 |

* cited by examiner

STANDING SEAM CEMENTITIOUS ROOF

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

This invention relates to construction of cementitious structures. In particular, the invention relates to a system and method for using inserts and a coating for architecturally finishing seams between roof panels of cementitious materials.

Cementitious roof panels, specifically Autoclaved Aerated Concrete ("AAC") roof panels, have been used for many years. There are many advantages of cementitious roof panels: durability, no rot nor decay, and strength. AAC roof panels additionally have insulation value due to their mass and the fact that they are aerated.

Applying a thin coating over AAC roof panels to weatherproof the roof has disadvantages. A primary disadvantage is that it is aesthetically undesirable because panel seam joints are difficult to repair. Moreover, even if the panel seam joints are repaired, the resulting large, smooth monotonous roof surface is unbecoming.

In the background art, these problems of using AAC roof panels have been solved by using expensive secondary roofing materials to weatherproof the roof. Normally, a pressure treated furring strip board is attached to AAC roof panels and then plywood sheets are nailed to the furring strips. A weatherproof asphalt paper is then stapled over the wood decking. Finally, a finished roofing system, such as asphalt shingles, etc. is installed. This approach to weatherproofing ACC roofs is accomplished at greater expense and labor than is necessary to weatherproof conventional wood roofs. Additionally, the asphalt shingles and other materials need to be replaced after about fifteen years so there is great amount of pollution in landfills, etc. There is a strong need for an environmentally friendly, permanent roof system.

It is usually cost prohibitive to add more expensive types of roofing, e.g., standing seam steel roofing, to an AAC roof. Moreover, standing seam steel roofs have an enormous amount of embodied energy and use valuable steel that would be better used for other purposes.

The finishing of the interior surface of AAC roof panels requires that sheetrock or thick plaster be applied in order to produce an architecturally acceptable interior finish. The panels are normally installed horizontally, spanning from one interior load-bearing wall to another. The (first) lowest panel is placed initially and secured and then the subsequent panels are installed by resting them on the first panel. The panels are normally not installed vertically (from fascia to ridge line) due to the butt ends not having a place to rest, and the difficulty of aligning the butt ends to produce a uniform (flush) exposed edge. Therefore the background art's added labor and materials required to construct a habitat employing AAC roof panels were excessive to extent the inherit advantages of ACC could not be appreciated.

For the reasons presented above, background art cementitious roof panel systems have been covered with conventional roofing materials at great additional labor, waste of materials and cost. The applicant's disclosures of roof coating, gravity fed gutters and panel fascia have provided an environmentally-friendly and cost-effective weather proofing system. There is a very strong need for environmentally-friendly roofing materials for AAC structures that exhibit a low quantity of embodied energy that are aesthetically attractive so consumers will be motivated to purchase them.

There is a very strong need for manufacturing and construction processes wherein all the inherent advantages of AAC roof panels can be economically actualized. The optimum solution is for a simplified and economical field installation of a superior product that also would be architecturally appealing.

The background art is characterized by U.S. Pat. Nos. 7,104,020; and 7,204,060 and by U.S. Patent Application Nos. 2001/0045070; 2002/0078659; 2002/0174606; 2006/0003144; and 2007/0056223; the disclosures of which patents and published patent applications are incorporated by reference as if fully set forth herein. In the background art, AAC roof panels are installed horizontally to avoid the problems inherent in installing cementitious roof panels vertically. Background art structures that incorporated vertical roof panels are simple single ridge roofs. There are no examples of economically-viable, vertically-installed, cementitious roof panels on a roof with multiple hips and valleys. Background art AAC roof systems lack the architectural, aesthetic advantages of other roofing systems. Also the smooth roofs have problems of mortar in seams creating additional work to eliminate noticeable surface irregularities. Standing seam steel roofs have an enormous amount of embodied energy and use valuable steel that would be better used for other purposes.

BRIEF SUMMARY OF THE INVENTION

The purpose of preferred embodiments of the invention is to provide a coating and/or an insert that simulates standing seam for a cementitious roof. One advantage of preferred embodiments of the invention is that the use of the insert makes finishing the roof easier. Another advantage of preferred embodiments of the invention is that is a more aesthetically pleasing roof is produced. One object of preferred embodiments of the invention is to provide a cementitious roof system that emulates a standing seam steel roof. In a preferred embodiment, the invention is incorporated into structures disclosed by the applicant in U.S. Pat. No. 7,204,060 and by U.S. Patent Application Publication Nos. 2002/0078659; 2002/0174606; 2007/0056223; the disclosures of which patents and published patent applications are incorporated by reference as if fully set forth herein.

In a preferred embodiment, the invention is a manufacturing process and construction methodology that produces a finished roof that economically actualizes all the inherit advantages of AAC roof panels in an architecturally appealing design. This embodiment, in combination with the teachings of the applicant's other patent applications enables AAC roof panels to be installed vertically. By installing a simple insert into the seams between the panels alleviates and remedies the problem of unsightly seams and transforms them to be architectural advantageous and aesthetically appealing simulated standing seams.

In the background art, AAC roof panels are normally installed horizontally, spanning from interior load bearing wall to load bearing wall. The first (lower) panel is placed and secured and then the subsequent panels are installed by resting them on the first panel. The panels are normally not installed vertically (with their seams in a plane that is perpendicular to the exterior walls) due to the butt ends not having a place to rest, the difficulty of aligning the ends for an exposed uniform flush end. Therefore, in the background art, the additional labor and materials required to construct a habitat employing AAC roof panels were excessive to extent that the inherit advantages of ACC could not be appreciated.

In a preferred embodiment, the invention is a complimentary architectural component that is vertically aligned and inserted into joints between cementitious roof panels or cementitious wall panels. This embodiment concerns making a cementitious roof look like a standing seam steel roof by inserting protruding pieces in the roof panel joints that run from the fascia to the ridge, preferably on two-foot centers. The inserts render the joints between the cementitious panels easier to finish as well as producing a superior but less expensive and more environmentally friendly roof system that appears to be a very expensive standing seam steel roof that wastes the Earth's resources.

Using the disclosed inserts with the disclosed coatings, allows for a coating to be applied without labor intensive and costly joint finishing. Without the disclosed inserts being installed in the seams, each joint would have to be sanded smooth so that no imperfections would show through the thin roof coating. Moreover, without the use of the disclosed inserts an ugly and boring roof profile is produced.

In another preferred embodiment, the invention is a coating for the exposed surfaces of cementitious roof panels and associated seam inserts. Preferably, the coating is a combination of two primary components: a powder (A) and a water-based liquid (B). The primary components are preferably mixed together at a strict weight ratio of 60 percent A and 40 percent B. The combination is a water-based liquid roof weatherproofing material that is vapor permeable. It may be tinted various colors, may be applied in a single coat, and is capable of adhering granules to the surface being coated. The roofing disclosed herein is water based, environmentally friendly and never has to be removed as do asphalt shingles, etc. Instead of replacing this roofing material, one simply has to apply a new coating of the disclosed coating material.

In this preferred embodiment, a batch of the coating combination is made by combining about 55 pounds of powder A with about 22 pounds of liquid B. Powder A is preferably comprised of Portland cement in the range of about 40 percent to about 60 percent by weight and a crystalline quartz silica in the range of about 40 percent to about 60 percent by weight. The liquid is preferably comprised of an acrylic polymer dispersion. Preferably, the acrylic polymer dispersion constitutes 100 percent of the liquid. For example, the acrylic polymer dispersion is preferably Levelite Bonding Primary made by Elite of Atlanta, Ga. In a preferred embodiment, after the coating is applied, granules are added to the surface to protect it from ultraviolet (UV) rays, etc.

In a preferred embodiment, the invention is a method for installing a roofing system on a structure, said method comprising: installing a plurality of cementitious roof panels adjacent to one another to produce a roof surface having a plurality of substantially vertical oriented seams; placing a cementitious seam insert in each seam and attaching each said seam insert to the adjacent cementitious roof panels; and coating said cementitious roof panels and said cementitious seam inserts with a coating. Preferably, said plurality of cementitious roof panels comprises two autoclaved aerated roof panels. Preferably, each said seam insert comprises a body that comprises a rigid cementitious board. Preferably, each said seam insert further comprises shoulders that are fixed to said body. Preferably, said shoulders are provided with channels adjacent to their connections to said body. Preferably, said body has a plurality of transverse holes. Preferably, the structure has a ridgeline and an eave or integrated gutter system said substantially vertical seams and said seam inserts run from adjacent to said ridgeline to adjacent said eave or integrated gutter system, thereby producing a roof that requires no further finishing and resembles a standing seam steel roof. Preferably, the method further comprises: cutting a groove or slot in each panel; and installing a seam insert in each groove or slot; thereby creating a standing seam look. Preferably, the method further comprises: cutting or forming an integrated gutter system into said cementitious roof panels. Preferably, the method further comprises: cutting or notching an integrated gutter system into said seam inserts.

In another preferred embodiment, the invention is a system for installing (or manufacturing and installing) a roofing system on a structure, said system comprising: means for installing a plurality of cementitious roof panels adjacent to one another to produce a roof surface having a plurality of substantially vertical oriented seams (e.g., the equipment required to manufacture, lift and place the panels, such as mixers, molds, cranes, forklifts, etc.); means for placing a cementitious seam insert in each seam and attaching each said seam insert to the adjacent cementitious roof panels (e.g., the equipment required to manufacture, lift, place and attach the seam inserts, such as mixers, molds, presses, cranes, forklifts, mortar, etc.); and means for coating said cementitious roof panels and said cementitious seam inserts with a coating (e.g., the equipment required to manufacture and apply the coating, such as mixers, brushes, trowels, etc.). Preferably, said plurality of cementitious roof panels comprises two autoclaved aerated roof panels. Preferably, each said seam insert comprises a body that comprises a rigid cementitious board. Preferably, each said seam insert further comprises shoulders that are fixed to said body. Preferably, said shoulders are provided with channels adjacent to their connections to said body. Preferably, said body has a plurality of transverse holes. Preferably, the structure has a ridgeline and an eave or integrated gutter system said substantially vertical seams and said seam inserts run from adjacent to said ridgeline to adjacent said eave or integrated gutter system, thereby producing a roof that requires no further finishing and resembles a standing seam steel roof. Preferably, the system further comprises: means for cutting a groove or slot in each panel (e.g., conventional cutting equipment for cementitious materials, such as saws, etc.); and means for installing a seam insert in each groove or slot (e.g., the equipment required to manufacture, lift, place and attach the seam insert, such as mixers, molds, presses, cranes, forklifts, mortar, etc.); thereby creating a standing seam look. Preferably, the system of further comprises: means for cutting or forming an integrated gutter system into said cementitious roof panels (e.g., convention equipment for cutting and sealing AAC, such as saws, coatings, brushes, etc.). Preferably, the system further comprises: means for cutting or notching an integrated gutter system into said seam inserts (e.g., convention equipment for cutting and sealing cementitious material, such as saws. etc.).

In another preferred embodiment, the invention is a roofing system for a structure having a ridgeline and an eave, said roofing system comprising: a plurality of cementitious roof panels that are installed substantially adjacent to one another and extend from the ridgeline to the eave to produce a surface having a plurality of substantially vertical oriented seams; a plurality of cementitious seam inserts, each cementitious seam insert having a first portion that is situated within each seam and that is attached to the adjacent cementitious roof panels and a second portion that protrudes from said surface; and a coating that is applied to said surface of said cementitious roof panels and to said second portion of said cementitious seam inserts.

In another preferred embodiment, the invention is a roofing system comprising: a plurality of cementitious roof panels having exposed surfaces that are separated by a plurality of substantially vertical oriented seams; a plurality of cementitious seam inserts, each cementitious seam insert having a first portion that is attached to the adjacent cementitious roof panels and a second portion that protrudes from said surface; and a coating that is applied to said exposed surfaces of said cementitious roof panels and to said second portion of said cementitious seam inserts. Preferably, said coating comprises a combination of two primary components: a powder and a water-based liquid. Preferably, said primary components have a weight ratio of about 60 percent powder and about 40 percent water-based liquid. Preferably, said powder is comprised of Portland cement in the range of about 40 percent to about 60 percent by weight and a crystalline quartz silica in the range of about 40 percent to about 60 percent by weight and said liquid is an acrylic polymer dispersion.

In another embodiment, the invention is a roofing system or a structure having a roof system produced according to a method disclosed herein. In another embodiment, the invention is a method for installing a roofing system on a structure, said method comprising: a step for installing a plurality of cementitious roof panels adjacent to one another to produce a roof surface having a plurality of substantially vertical oriented seams; a step for placing a cementitious seam insert in each seam and attaching each said seam insert to the adjacent cementitious roof panels; and a step coating said cementitious roof panels and said cementitious seam inserts with a coating; wherein said plurality of cementitious roof panels comprises two autoclaved aerated roof panels; wherein each said seam insert comprises a body that comprises a rigid cementitious board; wherein each said seam insert further comprises shoulders that are fixed to said body; wherein said shoulders are provided with channels adjacent to their connections to said body; wherein said body has a plurality of transverse holes; and wherein the structure has a ridgeline and an eave or integrated gutter system said substantially vertical seams and said seam inserts run from adjacent to said ridgeline to adjacent said eave or integrated gutter system, thereby producing a roof that requires no further finishing and resembles a standing seam steel roof.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate presently preferred embodiments of the invention. In the drawings.

Figure 1:
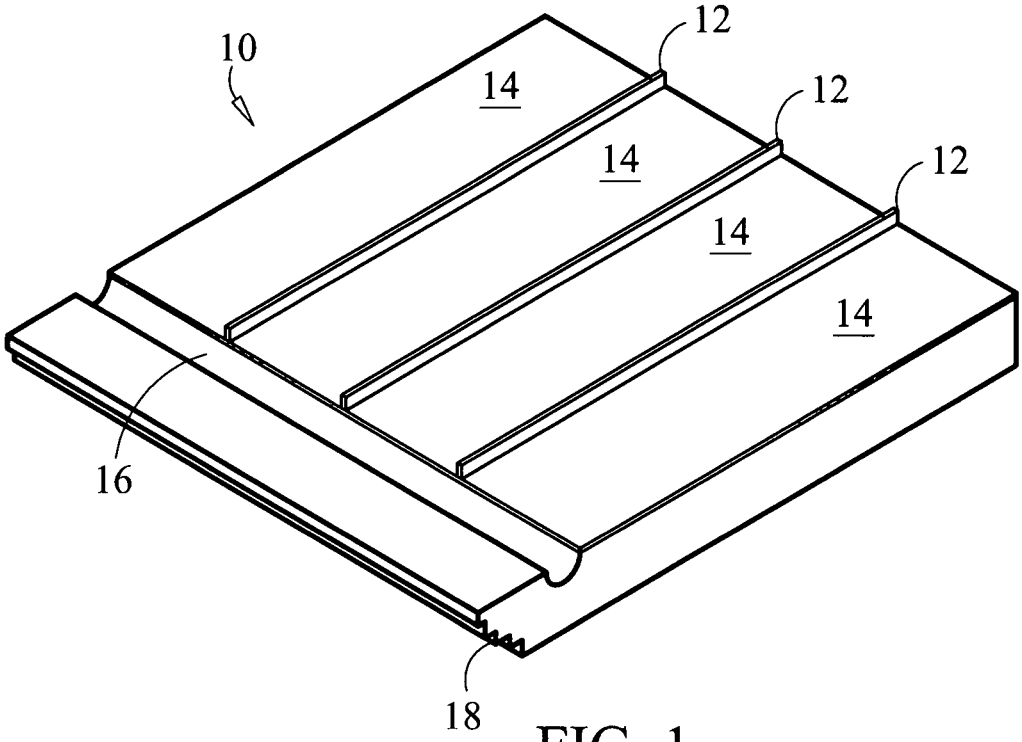
FIG. 1 is a perspective view of a preferred embodiment of a standing seam AAC roof.

The following reference numerals are used to indicate the parts and environment of the invention on the drawings:

10 standing seam AAC roof
12 seam inserts, inserts
14 AAC roof panels, roof panels
16 integrated gutter system, integrated gutter
18 fascia water deflection system, fascia
20 holes
22 mortar
24 panel seam
25 body
26 shoulders, transverse shoulders
28 channel
30 coating, coating material, roofing coating material
32 slot
34 first portion
36 second portion

DETAILED DESCRIPTION OF THE INVENTION

Referring to FIG. 1, a preferred embodiment of standing seam AAC roof 10 is presented. In this embodiment, one of a plurality of seam inserts 12 is mortared into the seam between each pair of ACC roof panels 14. Preferably, each of the seam inserts 12 is comprised of body 25 comprising a rigid cementitious board.

Figure 2:
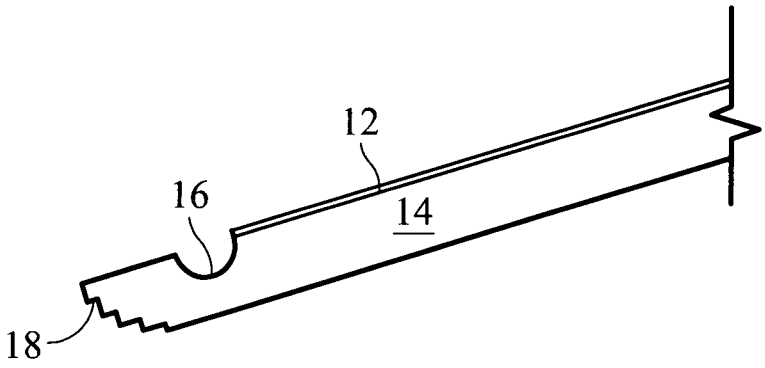
FIG. 2 is an elevation view of a preferred embodiment of a standing seam AAC roof.

Referring to FIG. 2, an elevation view of standing seam AAC roof 10 of FIG. 1 is presented. In this embodiment, each seam insert 12 terminates above integrated gutter 16 and fascia 18. Thus, this embodiment incorporates the integrated, gravity-fed gutter system and the fascia water deflection system disclosed at column 20, lines 39-57 of U.S. Pat. No. 7,204,060. The integrated gutter system and the fascia water deflection system are also disclosed in FIGS. 1, 2A, 2B, 2C, and 2D of U.S. patent application Ser. No. 11/123,635, the disclosure of which patent application is incorporated by reference as if fully set forth herein. In an alternative embodiment, the integrated gutter system is cut or formed into roof panels 14 before or after they are installed. In another alternative embodiment, the integrated gutter system is cut or formed into seam inserts 12 before or after they are formed. In this embodiment, a notch is provided in each seam insert 12 through which the gutter passes.

Figure 3A:
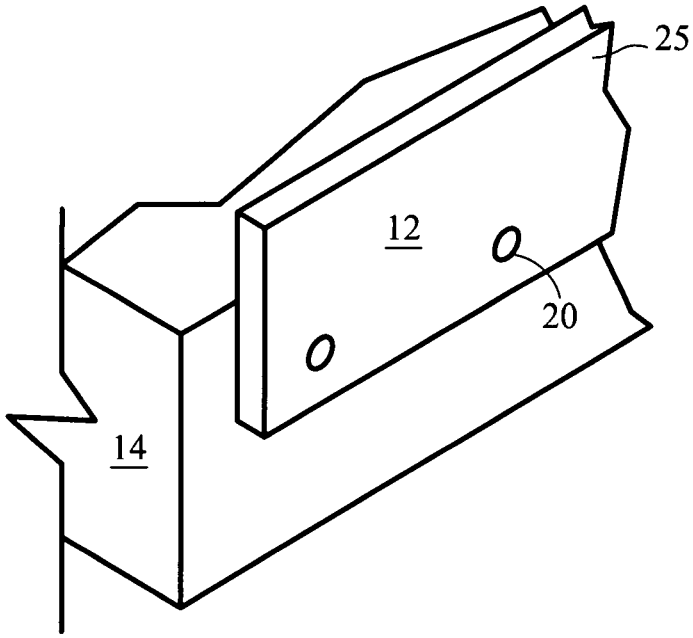
FIG. 3A is a perspective view of a first embodiment of the seam insert of a preferred embodiment of the invention. The seam inset is shown inserted into a seam between two AAC roof panels. The near roof panel is not shown for clarity.
Figure 3B:
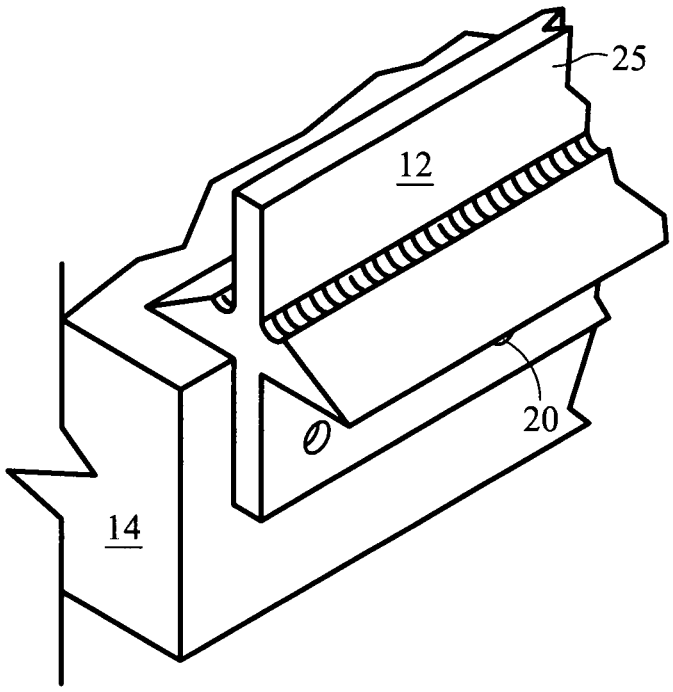
FIG. 3B is a perspective view of second embodiment of the seam insert of a preferred embodiment of the invention. The seam inset is shown inserted into a seam between two AAC roof panels. The near roof panel is not shown for clarity.

Referring to FIGS. 3A and 3B, a first (simple) embodiment and a second (complex) embodiment of one of the seam inserts 12 are illustrated. In both of these embodiments, seam inserts 12 are preferably comprised of body 25 that is made of a cementitious material. Holes 20 in tower vertical half of the body 25 of each of the inserts 12 are preferably provided to allow the mortar 22 in each panel seam 24 to embed each of the inserts 12 into the panel seam 24 and lock it into place. Preferably, after inserts 12 are installed and mortar 22 has set, coating 30 is applied to the exposed surfaces of installed roof panels 14 and inserts 12.

Figure 4:
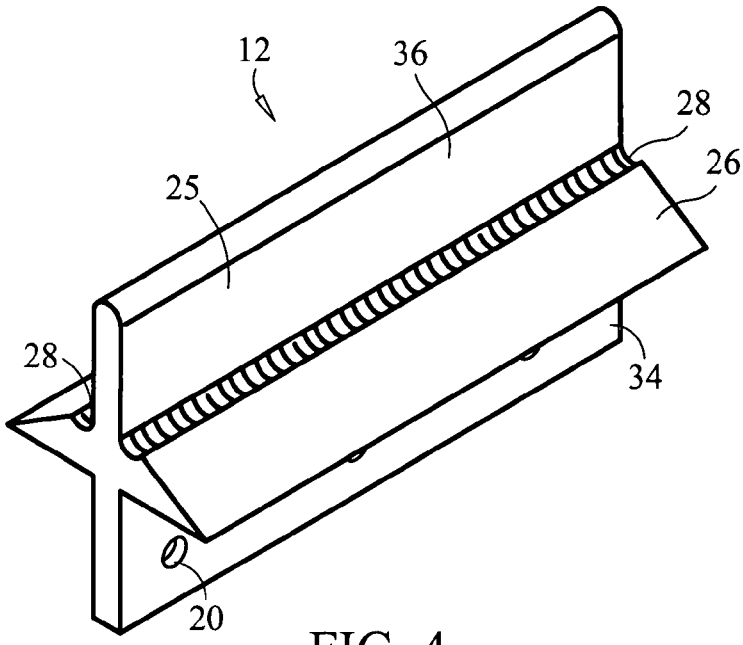
FIG. 4 is a perspective view of the embodiment of the seam insert of FIG. 3B showing the channels in the shoulders of the embodiment.

Referring to FIG. 4, transverse shoulders 26 are shown extending from the sides of the body 25 of each of the inserts 12. The presence of shoulders 26 enable workers to easily maintain a consistent height at which each of the inserts 12 protrudes out of each panel seam 24. Shoulders 26 are preferably provided with recessed channel 28 that locks roofing coating material 30 into the channels 28 when roofing coating material 30 cures. Channels 28 also provide an anchor area for the coating as it extends over the top of each of the seam inserts 12. It is preferred that coating 30 completely cover and coat the inserts 12 as well as the panels 14 because weathering is expected to prevent the inserts 12 from color matching the coating 30 over time.

Figure 5:
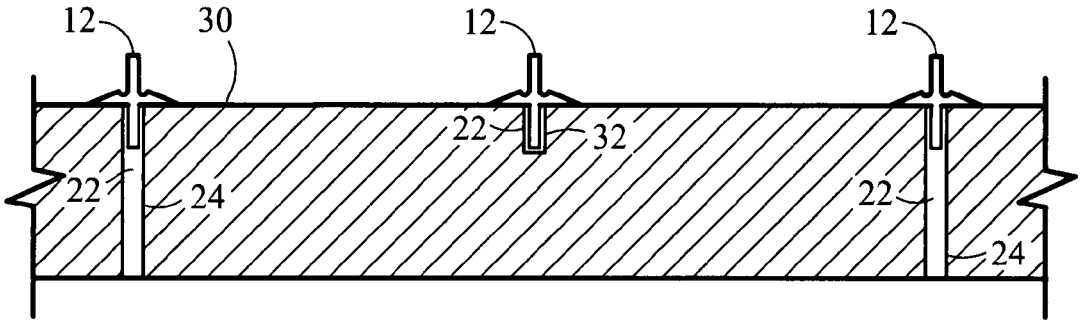
FIG. 5 presents a cross section view of installed roof panels with seam inserts installed in seams and in a slot cut into the middle roof panel. In this embodiment, the roof panels and seam inserts are coated with a coating material.

Referring to FIG. 5, a cross section view of installed roof panels 14 with seam inserts 12 installed in seams 24 and in slot 32 that is cut down the middle roof panel. In this embodiment, roof panels 14 and seam inserts 12 are coated with coating material 30. With panels 14 aligned in parallel, when mortar 22 is applied, inserts 12 make a clean joint that requires no other finishing work before coating material 30 is applied.

In an alternative embodiment (not shown), each of the seam inserts 12 is provided with shoulders 26 and a second portion 36, but is not provided with a first portion 36. In this embodiment, inserts 12 have the shape of an inverted capital T. In this embodiment, inserts 12 are attached to the exposed surface of panels 14 over seams 24 with an adhesive or with mortar before being coating with coating 30.

Figure 6:
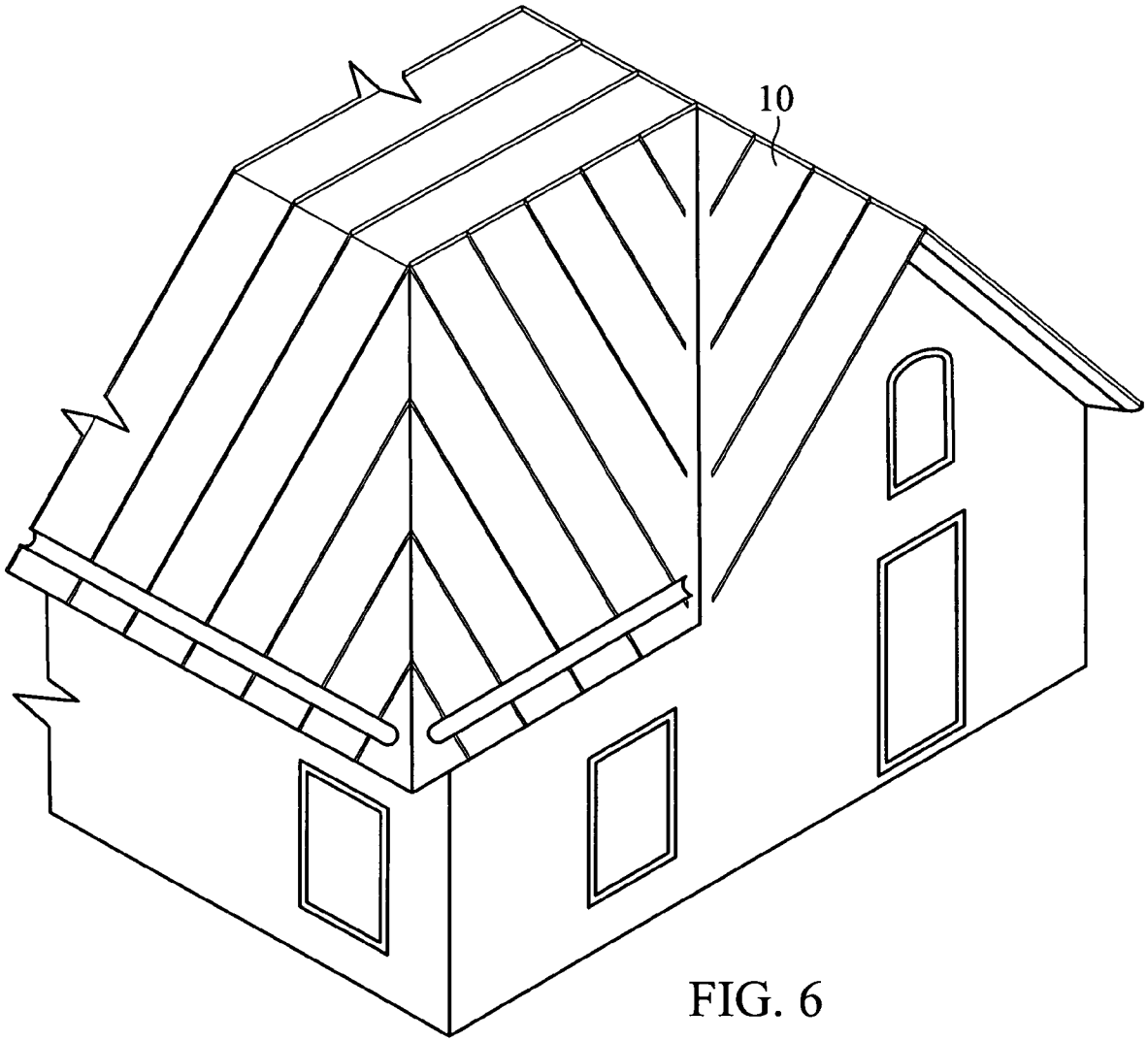
FIG. 6 is a perspective view of the standing seam roof in accordance with a preferred embodiment of the invention. In this embodiment, the roof has hips and valleys.

Referring to FIG. 6, a perspective view of a structure with a standing seam roof 10 is presented. In this embodiment, roof 10 has hips and valleys. In this embodiment, a simple cementitious board insert 12 is inserted into seams 24 and then roof coating 30 is applied to all materials (panels 14 and inserts 12) simultaneously. In this way, a roof system is produced that hides joints with no other finishing. The seam inserts can be coated with the roof at same time as the roof panels, producing one constant seamless roof coating system. Preferred embodiments of the invention produce a roof that has inserts in the vertically-oriented gaps or seams between roof panels, the gaps or seams being located in planes that are oriented substantially perpendicular to the outside walls of the structure.

Many variations of the invention will occur to those skilled in the art. Some variations include a simple insert. Other variations call for a complex insert. All such variations are intended to be within the scope and spirit of the invention.

Although some embodiments are shown to include certain features, the applicant specifically contemplates that any feature disclosed herein may be used together or in combination with any other feature on any embodiment of the invention. It is also contemplated that any feature may be specifically excluded from any embodiment of the invention.

What is claimed is:

1. A rooting system comprising:

a pair of cementitious roof panels that are separated by at least one substantially vertically oriented seam;

each of said roof panels comprising a hexahedron configuration and having interconnected spaced end walls and spaced side walls;

at least one seam insert partially disposed in said seam and having a first portion that is attached to the cementitious roof panels and a second portion that extends upwardly from said root panels;

a first coating applied to said cementitious root panels and to said second portion of the at least one seam insert;

each of said cementitious roof panels comprising spaced top and bottom walls having substantially planar surfaces extending between said end walls and said side walls; and the second portion of the at least one seam insert extending above an imaginary plane in coincidence with said top surface of each roof panel a distance sufficient to receive said first coating.

2. The roofing system of claim 1 wherein said first coating comprises a waterproof, vapor permeable coating that has a high modulus of elasticity while remaining cooperatively adhered to cementitious products.

3. The roofing system of claim 2 wherein said first coating comprises primary components with a weight ratio of about 60 percent powder and about 40 percent water-based liquid.

4. The rooting system of claim 3 wherein said powder is comprised of Portland cement in the range of about 40 percent to about 60 percent by weight and a crystalline quartz silica in the range of about 40 percent to about 60 percent by weight and said liquid is an acrylic polymer dispersion.

5. The roofing system of claim 3 wherein a second coating comprises protective granules and the second coating is configurable to be applied while the first coating is wet.

6. A roofing system comprising:

a plurality of cementitious roof panels having exposed surfaces that are separated by at least one substantially vertically oriented seam;

at least one seam insert having a first portion that is attached to the cementitious roof panels and a second portion that protrudes from said exposed surfaces;

said cementitious roof panels being attached;

each of said root panels having spaced lop and bottom surfaces;

a coating applied to said exposed surfaces of said cementitious roof panels and to said second portion of the at least one seam insert;

the at least one seam insert visibly protruding above said top surfaces of the attached cementitious roof panels;

the at least one seam insert comprising a cross-shaped insert, the cross-shaped insert comprising:

an upper portion that extends above the lop surfaces of the attached cementitious roof panels;

a lower portion that extends below the top surfaces of the attached cementitious roof panels;

a plurality of arms that extend outwardly along a plane of the lop surfaces of the attached cementitious roof panels; and a recessed channel along the seam between the upper portion and each of the plurality of arms.

7. The roofing system of claim 6 wherein the recessed channel comprises an anchor area for the coating.

8. The rooting system of claim 6 wherein the plurality of arms define the depth that the lower portion extends below the top surfaces of the attached cementitious roof panels.

* * * * *